340-567
4/21/81 SR
OR 4,263,585

United States Patent [19]

Schaefer

[11] 4,263,585

[45] Apr. 21, 1981

[54] INTRUSION DETECTION SYSTEM WITH A SEGMENTED RADIATION SENSING MIRROR

[76] Inventor: Hans J. Schaefer, 312 Marich Way, Los Altos, Calif. 94022

[21] Appl. No.: 65,920

[22] Filed: Aug. 13, 1979

[51] Int. Cl.[3] ..... G08B 13/18

[52] U.S. Cl. ..... 340/567; 250/221; 250/342; 350/296

[58] Field of Search ..... 340/567, 565, 556, 555; 350/292, 293, 294, 296; 250/221, 342

[56] References Cited

U.S. PATENT DOCUMENTS

| | | | |
|---|---|---|---|
| 2,972,743 | 2/1961 | Svensson et al. | |
| 3,036,219 | 5/1962 | Thompson . | |
| 3,169,189 | 2/1965 | Barnes et al. | |
| 3,250,174 | 5/1966 | Lutz . | |
| 3,271,575 | 9/1966 | Falbel . | |
| 3,383,511 | 5/1968 | Palser . | |
| 3,631,434 | 12/1971 | Schwartz | 340/567 |
| 3,703,718 | 11/1972 | Berman | 340/567 |
| 3,708,222 | 1/1973 | Stern . | |
| 3,760,399 | 9/1973 | Schwarz | 340/567 |
| 3,839,640 | 10/1974 | Rossin . | |
| 3,928,843 | 12/1975 | Sprout et al. | 340/567 |
| 3,955,184 | 5/1976 | Cinzori et al. | 340/567 |
| 3,958,118 | 5/1976 | Schwarz | 340/567 |
| 3,972,598 | 8/1976 | Kunz | 340/567 |
| 3988,726 | 10/1976 | Reiss et al. | 340/567 |
| 3,999,069 | 12/1976 | Taylor et al. | 250/342 |
| 4,058,726 | 11/1977 | Paschedag et al. | 250/342 |

OTHER PUBLICATIONS

"Passive Infra-Red Intruder Alarms Using Plessey Pyroelectric Detectors" Plessey Optoelectronics & Microwave, Ltd., Towcester, Northants, Eng.

"Infrared Thermoflakes", Product Data Bulletin 1R-1, Thermometrics, Edison, N.J.

*Writing Handbook,* Kammer, Michael P. & Mulligan, Carles W., p. 172, Loyola University Press, Chicago, 1953, 52-13885.

*Primary Examiner*—Glen R. Swann, III

*Attorney, Agent, or Firm*—Jack M. Wiseman; Francis W. Anderson

[57] ABSTRACT

An intrusion detection system has an optical device for focusing radiation energy onto radiation sensing elements. Connected to the sensing elements is a circuit which produces intrusion signals from detected radiation energy for controlling the operation of an alarm. The optical device has a sensing mirror with a concave reflective surface that comprises a plurality of pairs of vertically disposed contiguous reflective segments. The reflective segments of the sensing mirror have the same vertical curvature, but the pairs of reflective segments differ from one another in horizontal curvature, in the area of reflective surface and in the horizontal focal lengths. The reflective segments of the sensing mirror will reflect radiation energy from a wide range of angles offset from the direction of the center line of the optical device and project the radiation energy onto a focusing mirror, which, in turn, casts the radiation energy onto the sensing elements. The cluster of sensing elements is disposed along the center line of the sensing mirror.

30 Claims, 10 Drawing Figures

Fig. 5
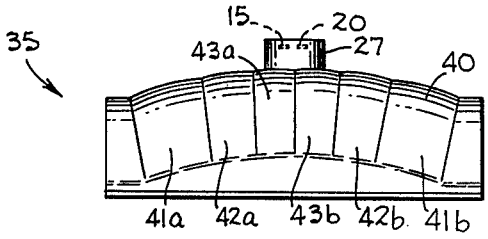
Fig. 3
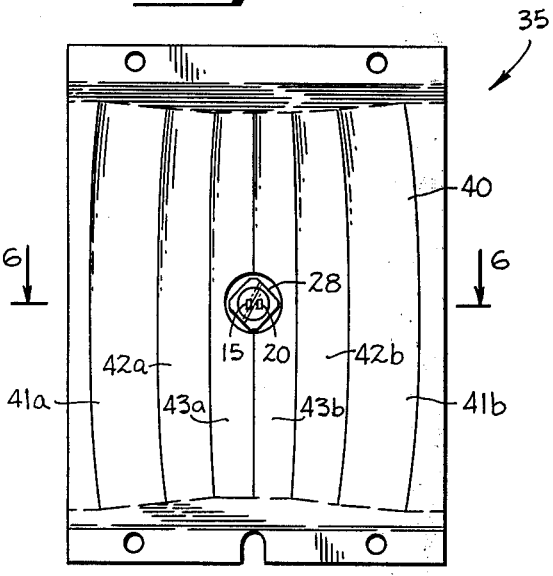
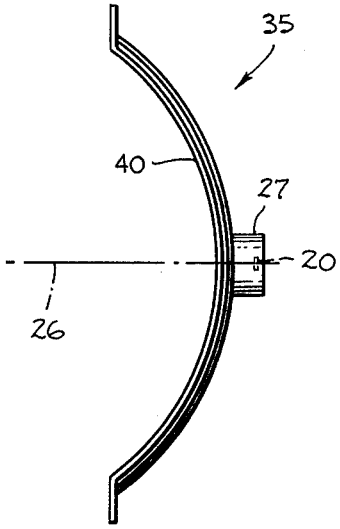
Fig. 4
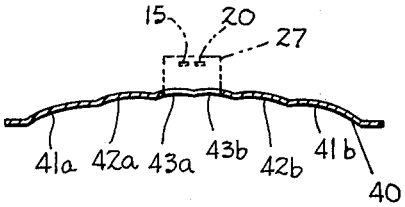
Fig. 6

INTRUSION DETECTION SYSTEM WITH A SEGMENTED RADIATION SENSING MIRROR

BACKGROUND OF THE INVENTION

The present invention relates in general to intrusion alarm systems and more particularly to an intrusion alarm system that detects the presence of an intruder by sensing radiation energy.

Intrusion alarm systems have been known to sense variations in radiation energy to detect the presence of an intruder. The variations in radiation energy have been employed to activate an alarm. The optical device employed in such systems has been designed to reflect variations in radiation energy from a long, narrow beam that is highly directive, or from a wide angle, short beam. Wide angle systems have been manufactured by Raytek, a division of Optical Coating Laboratory of Santa Rosa, California. Passive infrared intruder alarms using Plessey pyroelectric detectors have been described in advertising literature published by Plessey Optoelectronics & Microwave Limited, Towcester, Northants, England. The article by Plessey Optoelectronics also describes pyroelectric detectors used in such systems. Advertising literature has also been published by Thermometrics, Inc., of Edison, New Jersey, on infrared detectors for intruder alarm systems, and particularly detectors employing thick film thermister flakes and segmented optical mirrors.

Heretofore, intruder alarm systems employed sensing mirrors with spherical sections. The radii of the spherical sections were the same. Thus, the radii were equal in the vertical direction and in the horizontal direction. Therefore, the surveillance of the target area comprised circular sections. As a consequence thereof, sensing mirror sections were placed below the main arrangement of sensing mirror sections to cover adequately the central section of the area under surveillance. Additionally, the sensing mirror sections were spaced apart.

Intruder alarm systems should be able to detect an intruder and also it is essential that the intruder alarm system be free from false alarms. In the wide angle, passive radiation intruder alarm systems, false alarms can be triggered by various events, such as temperature change in a confined space, vertically moving air currents, electrical noise, power line transients and the like.

Heretofore, false alarms in the passive, wide angle radiation intruder alarm systems were caused by air currents brought about by moving clouds, floor heaters, et cetera. Such air currents were in the nature of vertical air currents. False alarms in the passive, wide angle radiation intruder alarm systems were caused by radio frequency signals, such as those produced by microwave generating equipment, electric motors, RF oscillators and the like. When thermisters are employed as the sensing device, false alarms occur because the thermisters are sensitive to RF fields. In prior systems, the thermisters were disposed in front of the optical device at the most exposed location in the detection system because of the optical device employed, instead of adjacent the amplifier which would provide improved shielding from RF energy or the like.

In the patent to Berman, U.S. Pat. No. 3,703,718, issued on Nov. 21, 1972, for Infrared Intrusion Detection System, there is disclosed a passive, wide angle infrared intrusion detection system in which an optical device focuses infrared radiation for impinging on a sensing element. The optical device comprises a plurality of spaced apart, vertically disposed segments and has a concave reflecting surface. The segments are formed by cutting the mirror along a plurality of parallel planes, which are also parallel to the axis of the mirror. The reflective segments have substantially equal reflective areas. In a modification of the system, a sensing element is mounted in front of the segmented spherical mirror.

The patent to Sprout et al., U.S. Pat. No. 3,928,843, issued on Dec. 23, 1975, for Dual Channel Infrared Intrusion Alarm System discloses an intrusion alarm system utilizing two sensing elements and two signal processing channels such that an intruder produces signals of opposite polarities in the two channels. An alarm is triggered in the event two signals of opposite polarities are present at the same time. The optical device reflects infrared energy eminating from a plurality of spaced apart fields of view and focuses the energy onto a sensor. The optical device has a concave reflecting surface and includes five vertically extending segments with two horizontally extending segments disposed above the vertical segments. The sensors are associated with each of the vertical segments of the optical device.

In the patent to Cinzori et al., U.S. Pat. No. 3,955,184, issued on May 4, 1976, for Passive Infrared Room Intrusion Detector, there is disclosed an intrusion system in which one of the optical devices has concave reflecting surfaces. The reflective surfaces reflect orthogonal fields of view which are thin curtain-like polyhedrons coextensive with planar surfaces of the room. The patent to Falbel, U.S. Pat. No. 3,271,575, issued on Sept. 6, 1966, for Catoptric Radiometric Detector discloses an instrument for detecting optical radiation from a target in which the collecting optics are illustrated as a typical Cassegrain system with a primary mirror and a secondary mirror. A truncated cone is employed with a highly reflective inner surface and a sensor is mounted at the truncation. The patent to Rossin, U.S. Pat. No. 3,839,640, issued on Oct. 1, 1974, discloses a passive intrusion detection device in which a concave mirror has the sensor mounted on the focus of the front reflective surface of the concave mirror. In the patent to Stern, U.S. Pat. No. 3,708,222, there is disclosed a rear-view mirror for a vehicle, which is a Fresnel mirror. The mirror is formed from a plurality of concentric annular prisms to provide a wider field of view.

Other patents of interest are:

Cruse—U.S. Pat. No. 3,524,180

French patent to Cupuano et al.—U.S. Pat. No. 1,464,783

Osborne—U.S. Pat. No. 3,480,775

Bradshaw et al.—U.S. Pat. No. 3,766,539

Schwartz—U.S. Pat. No. 3,631,434

SUMMARY OF THE INVENTION

An intrusion detection system comprises optical means for focusing radiation from an area under surveillance onto sensing elements. The optical means has a concave reflective surface that is comprised of a plurality of reflective segments. All the reflective segments have the same curvature in one direction. In another direction, the curvatures of the reflective segments vary.

A feature of the present invention is the positioning of reflective segments in the vertical direction. The reflective segments have the same vertical curvature. The horizontal curvature is different for adjacent reflective segments.

Another feature of the present invention is that the optical means has a concave reflecting surface that is comprised of a plurality of pairs of vertically disposed reflective segments. The reflective segments have the same vertical curvature. The pairs of reflective segments differ from one another in horizontal curvature, in the area of reflective surface, and in the horizontal focal lengths.

By virtue of the present invention, the reflective segments will not only reflect radiation energy along the centerline of the sensing mirror of the optical means, but also over a wide range of angles offset from the direction of the center line of the sensing element of the optical device.

The present invention provides optical means that makes maximum use of the reflecting surface of the sensing mirror. Higher sensitivity and increased area of surveillance is achieved by the intrusion detection system of the present invention because the present invention obviates the gaps between adjacent segments. In the optical means of the present invention, the sensing mirror has basically horizontal responses and the focusing mirror has basically vertical responses. In the present invention, the increased area of surveillance is achieved by increasing the effective vertical responses of the focusing mirror.

In wide range intrusion detection systems, false alarms have been a common problem. The present invention reduces the false alarms resulting from air currents. By detecting differential signals from horizontal target movement, and integrating or counting a predetermined number of signals before an alarm is triggered, the false alarms created by air currents have been reduced. Focusing optics, as disclosed by the present invention, provide for a plurality of comparison signals. There is a continuous variation of sensing intensity from a target to produce the plurality of comparison signals. By integrating and counting the plurality of comparison signals, false alarms have been reduced. Lastly, false alarms from radio frequency pickup signals have been abated. The present invention provides optical means that enables the sensing elements to be located next to the amplifier or amplifiers and thereby allows improved shielding from radio frequency signals and other radiating electromagnetic disturbances.

DESCRIPTION OF THE DRAWINGS

FIG. 3 is a front elevation view of the sensing mirror of the optical means shown in FIG. 2.

FIG. 4 is a side elevation view of the sensing mirror shown in FIG. 3.

FIG. 5 is a plan view of the sensing mirror shown in FIGS. 3 and 4.

FIG. 6 is a transverse sectional view of the sensing mirror shown in FIGS. 3–5 taken along line 6—6 of FIG. 3.

DESCRIPTION OF THE PREFERRED EMBODIMENTS

Figure 1:
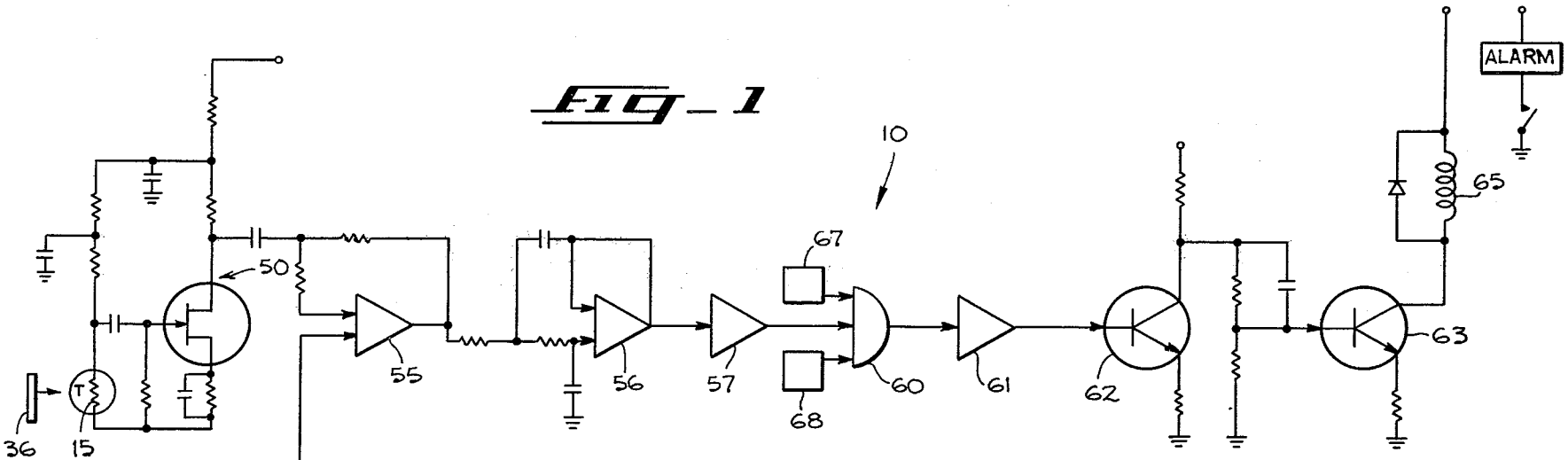
FIG. 1 is a schematic diagram of an intrusion detection system embodying the present invention.

Illustrated in FIG. 1 is an intrusion detection system 10 for passive, wide range intrusion detection of an area under surveillance. As a passive detection system, variations in radiation energy produced by intrusion in the area under surveillance are sensed. The radiation energy may be thermal radiation or may be infrared radiation. Persons intruding in the area under surveillance will emit thermal radiation and infrared radiation.

For detecting variations in radiation energy, the system 10 comprises conventional and suitable sensing elements, such as thermisters 15 and 20. Examples of other sensing elements that may be employed are piezo/pyro sensors, pyroelectric detectors and thick film thermister flakes and others. Variations in temperature or radiation, as for example variations of thermal energy and infrared energy, will produce in such sensing elements variations in the output current thereof.

Figure 2:
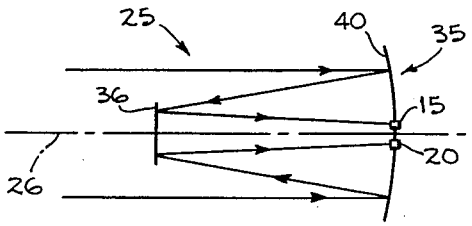
FIG. 2 is a diagrammatic illustration of optical means employed in the intrusion detection system shown in FIG. 1.
Figure 8:
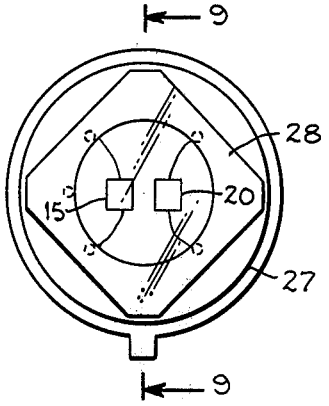
FIG. 8 is a front elevation of a housing containing sensing elements employed in the intrusion detection system embodying the present invention.
Figure 9:
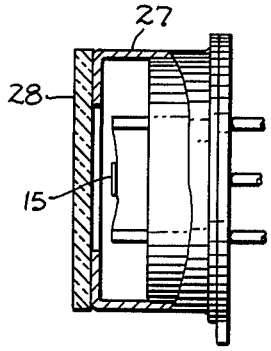
FIG. 9 is a section view of the housing containing sensing elements shown in FIG. 8 and taken along line 9—9 of FIG. 8.

The sensing elements 15 and 20 (FIGS. 8 and 9) are disposed in a cylindrical housing 27, such as a header employed in packaging semiconductor devices in close proximity to one another. The header housing 27 is hermetically sealed. Additionally, the sensing elements 15 and 20 are mounted in a horizontal plane normal to a vertical or horizontal plane through the center line of the area under surveillance. The axis of the header housing 27 is mounted generally along a center line 26 of optical means 25 (FIG. 2). A coated germanium window 28 is provided at the radiation sensing side of the housing 27 as a filter passing substantially only infrared radiation.

In order to focus radiation energy onto the sensing elements 15 and 20, the optical means 25 (FIG. 2) includes a sensing mirror 35 and a focusing mirror 36. The focusing mirror 36 is formed with a reflecting surface that may be of any suitable configuration, such as flat or curved convex with the curvature in the horizontal and vertical planes differing from one another. In the exemplary embodiment, the focusing mirror 36 is generally flat in the horizontal direction and has a slight curvature in the vertical direction. Vertical resolution is influenced by the focusing mirror 36. In a typical system, the focusing mirror 36 may be a horizontally disposed segment of a cylinder. The sensing mirror 35 faces the surveillance area and senses the radiation energy in the area under surveillance from a plurality of fields and casts the detected radiation energy onto the focusing mirror 36. In turn, the focusing mirror 36 impinges the reflected detected radiation energy onto the sensing elements 15 and 20, dependent on the area of the sensing mirror 35 detecting the radiant or thermal energy. The optical means 25 in some aspects is similar to a Cassegrain type optical device.

The sensing mirror 35 through its reflecting segments senses an area of surveillance of 90 degrees with each segment having a predetermined horizontal area of surveillance. The focusing mirror 36 serves to increase the vertical extent of the horizontal areas under surveillance. The combination thereof results in the variation of vertical lines of intensity defining vertical stripes. As a consequence thereof, we have more than two comparison signals for each segment.

More specifically, each reflecting segment of the sensing mirror 35 has a predetermined horizontal area of surveillance and the focusing mirror 36 serves to increase the vertical extent of the horizontal area under surveillance. The combination thereof results in the variation of vertical lines of intensity defining vertical strips. The combination resulting from each reflecting segment is a vertical band of intensity lines that defines a vertical strip. Each such band consists of a plurality of adjacent vertical lines which differ in intensity from one another. As a consequence thereof, a plurality of comparison signals is obtained for each reflecting segment.

The sensing elements 15 and 20 face toward the area under surveillance. By locating the axis of the housing 27 for the sensing elements 15 and 20 along the center line of the optical means 25, the sensing elements 15 and 20 are capable of being shielded from electromagnetic radiation to reduce radio frequency pick-up through being positioned in close proximity to the amplifier. Through this arrangement, the sensing elements 15 and 20 are connected directly to the input side of a contiguous amplifier or pre-amplifier in juxtaposed relationship, which aids in the shielding of the conductors therebetween. In addition, the sensing elements 15 and 20 are thereby adjustable relative to the focal point of the optical means 25. Such an amplifier or amplifiers are shown as amplifiers 50 and 51 in FIG. 1.

The sensing mirror 35 comprises a concave reflecting surface 40 (FIG. 4) suitable for detecting infrared or thermal radiation. In the preferred embodiment, the sensing mirror 35 (FIGS. 3, 5 and 6) is a one-piece or unitary structure. In the exemplary embodiment, the sensing mirror 35 is stamped out of an aluminum sheet. The reflecting surface 40 may also be referred to as a spherical reflecting surface. In the preferred embodiment, the sensing mirror 35 comprises vertically disposed reflecting segments 41*a*–43*a* and 41*b*–43*b*. The reflecting segments are in a contiguous, juxtaposed relation to form the continuous reflecting surface 40. Thus, there is continuity in the surveillance range without creating dead spaces or gaps in the detection of a target moving through the horizontal observation angle of ninety degrees.

The reflecting segments 41*a* and 41*b* form a pair in that they are formed with the same horizontal curvature, area size and focal lengths. In a similar manner, the reflecting segments 42*a* and 42*b* form a pair in that they are formed with the same horizontal curvature, area size and focal lengths. Lastly, the reflecting segments 43*a* and 43*b* form a pair in that they are formed with the same horizontal curvature, area size and focal lengths.

All of the reflecting segments 41*a*–43*a* and 41*b*–43*b* have the same vertical curvature. However, the reflecting segments 41*a*–43*a* differ from one another in that they have different horizontal curvature, area size and horizontal focal lengths. Similarly, the reflecting segments 41*b*–43*b* differ from one another in that they have a different horizontal curvature, area size, and horizontal focal lengths.

In the exemplary embodiment, the reflecting segments 43*a* and 43*b* have a vertical radius of 1.75 inches and a horizontal radius of 1.8 inches; the reflecting segments 42*a* and 42*b* have a vertical radius of 1.75 inches and a horizontal radius of 2.16 inches; and the reflecting segments 41*a* and 41*b* have a vertical radius of 1.75 inches and a horizontal radius of 3.6 inches.

The sensing mirror 35 of the present invention provides a horizontal surveillance angle of ninety degrees. Thus, each reflecting segment covers a surveillance area of fifteen degrees. The horizontal focal points are at the center of the horizontal surveillance angles or generally at the 7½ degree points of the surveillance angles. The number of segments or pairs of segments can be varied. Such variations will affect the angle of surveillance for each segment. If desired, the center pair of segments may be considered a single segment, in which event there will be an odd number of segments.

By virtue of the sensing mirror 35, the movement of a target through an angle of ninety degrees is focused onto the sensing elements 15 and 20 for scanning over the entire ninety degree width. The reflecting segments are juxtaposed along the vertical sides thereof to form a continuous reflecting surface without dead areas or gaps. The reflecting segments 41*a*–43*a* and 41*b*–43*b* will not be screening off portions of adjacent areas in relation to a signal from a target moving through the surveillance angle of ninety degrees to form dead areas. While the pairs of reflecting segments differ in reflecting surface area, they are substantially the same in sensitivity. Horizontal resolution is determined by the sensing mirror 35.

As previously described, the sensing mirror 35 reflects radiation energy onto the focusing mirror 36. In turn, the focusing mirror 36 causes the sensed radiation energy to impinge on the sensing elements 15 and 20. In the exemplary embodiment, the sensing mirror 35 has a height of 3⅜ inches and a width of 2½ inches. The depth of the sensing mirror 35 at the center thereof is ⅝ of an inch. The cylindrical opening at the center thereof for receiving the housing for the sensing elements 15 and 20 has a diameter of ⅜ of an inch.

Figure 10:
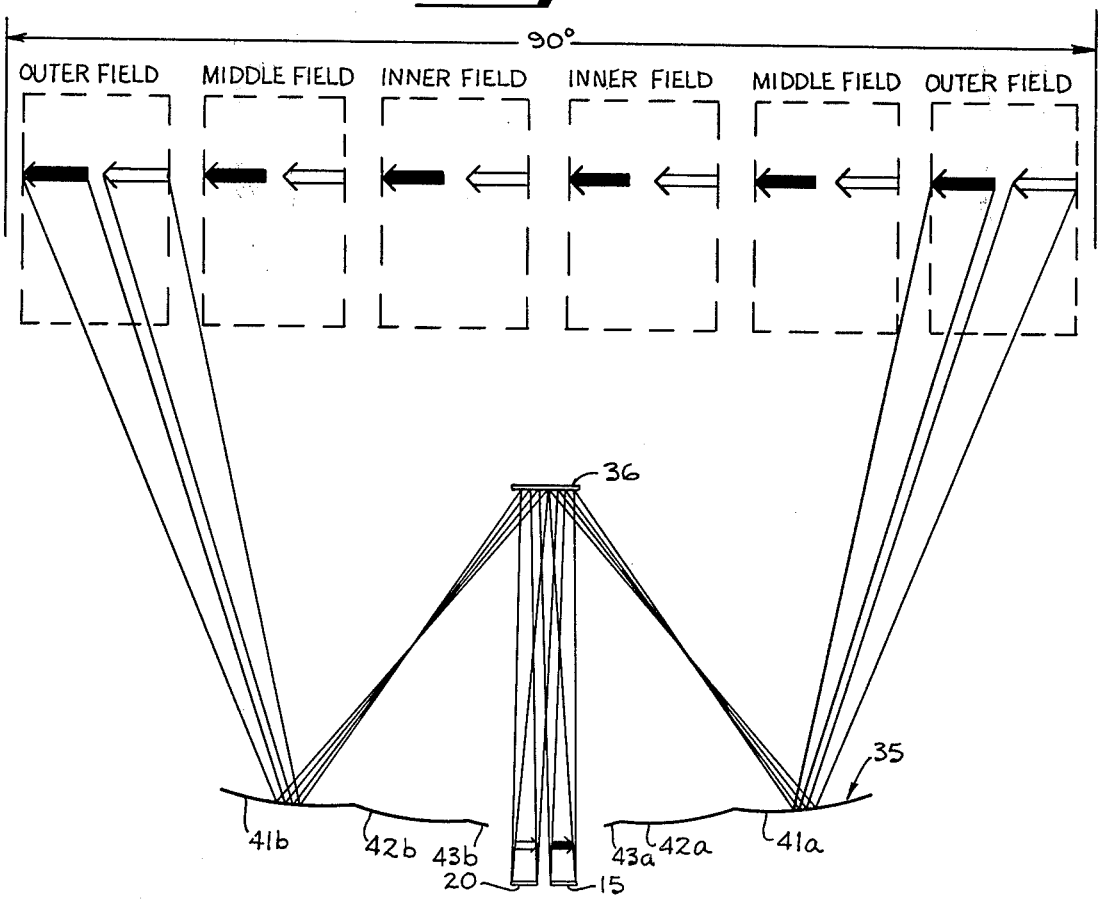
FIG. 10 is a diagrammatic illustration of an intrusion sensing operation of the optical means and the sensing elements employed in the intrusion detection system of the present invention.

As shown in FIG. 10, there are, in the exemplary embodiment, six adjacent fields in the surveillance area of ninety degrees. When an intruder enters any one of the fields, a reflecting segment of the optical device 25 associated therewith detects radiation energy eminating from the intruder and projects the radiation energy on the focusing mirror 36. The focusing mirror, in turn, casts the radiation energy on one of the sensing elements commencing on the outside edge thereof. As the intruder moves toward the center of the field intruded, the focusing mirror 36 impinges radiation energy on the one sensing element scanning the one sensing element thereacross. As the intruder advances beyond the center toward the opposite side of the field initially intruded, the focusing mirror 36 casts the radiation energy on the outside edge of the other sensing element. As the intruder moves toward the opposite end of the intruded field from which the intrusion was initiated, the focusing mirror 36 impinges radiation energy to scan the other sensing element thereacross. As the intruder leaves the first intruded field and intrudes on another adjacent field, the above operations are repeated for the other field with the focusing mirror 36 impinging radiation energy on the outside edge of the first sensing element.

Thus, the focusing mirror alternately impinges radiation energy on the sensing elements 15 and 20 commencing on the respective outside edges thereof. The impingement of the radiation energy alternately on the sensing elements 15 and 20 continues as the intruder moves about initially within a first intruded field, and alternately on the sensing elements 15 and 20 thereafter through each field intruded, respectively. The curvature of the sensing mirror 35 and the focusing mirror 36 subdivides each field into a number of vertical areas of different sensitivities. The columns of sensitivities are slightly curved to cause the radiation energy sensed by the sensing elements 15 and 20 to detect the movement of the intruder in the horizontal path and also the movement of the intruder toward and away from the sensing mirror 35.

The sensing elements 15 and 20, therefore, will be alternately and continuously scanned by the radiation energy emitted by an intrusion within the areas under surveillance to produce signals representing variations of vertical lines of intensity defining vertical strips. Hence, there are comparison signals emitted by the sensing elements 15 and 20.

The output of the sensing element 15 is amplified by the suitable amplifier 50 (FIG. 1). The output of the sensing element 20 is amplified by the suitable amplifier 51. Connected to the amplifiers 50 and 51 is a differential amplifier circuit 55. By the sensing elements 15 and 20 being alternately and continuously scanned by the emission of radiant energy by an intrusion in the areas under surveillance, alternate output signals will be produced in the output circuit of the amplifiers 50 and 51. The alternate excitation of the sensing elements 15 and 20 produce differential signal inputs to the amplifiers 50 and 51. This results from the horizontal movement of the intruder. Thus, the intrusion detection system 10 of the present invention does not rely on signal interruption by gaps in the sensing mirror and is generally insensitive to vertical movement of radiation sources. The amplifier 50 is a low frequency, high gain, low noise amplifier. The low frequency range of the amplifier 50 may be in the order of 0.5 Hz to 10 Hz.

The differential amplifier circuit 55 will produce a differential signal, which passes through a suitable low pass filter 56. The differential signal is proportional to the difference between the two input signals. In the exemplary embodiment, the filter 56 passes frequencies in the band between ½ Hz and 10 Hz. Connected to the output side of the filter 56 is an amplifier 57. Connected to the amplifier 57 is a discriminating and logic circuit that comprises a summing circuit 60 and an integrating amplifier 61. Optionally, the summing circuit 60 has a plurality of slave circuits 67 and 68 connected to the input side thereof. Each slave circuit includes components similar to amplifiers 50 and 51, differential amplifier 55, filter 56 and amplifier 57. The components of the slave circuits 67 and 68 operate and perform in a manner similar to the aforementioned components and are connected to sensing elements similar to sensing elements 15 and 20, and also employ optical devices similar to optical device 25. The slave optical devices will cover the same area of surveillance as does the optical device 25. The summing circuit 60, when employing slave units such as slave units 67 and 68, produces an output signal equal to the weighted sum of the input signals. The integrating amplifier 61 produces an output signal to trigger a suitable trigger circuit 62 after a predetermined number of signals meeting a prescribed magnitude has been produced by the summing circuit 60. A power amplifier 63 energizes an alarm relay 65, when the trigger circuit 62 conducts. The energization of the relay 65 closes contact thereof to operate an alarm 66 in a conventional manner.

The system of the present invention employs a continuous reflection of radiation energy from the intruder and not interrupted reflections of radiation energy from the intruder. Hence, the present invention has a continuous reflecting surface for sensing the intruder and does not require wasted space for producing gaps between reflecting segments. Therefore, the system of the present invention is more effective. The optical means of the present invention, in the preferred embodiment, subdivides the six main areas under surveillance into a multitude of curved column reflecting segments. In this manner, the triggering of a control circuit through a differential signal is more frequent than demonstrated by having merely six areas under surveillance.

Figure 7:
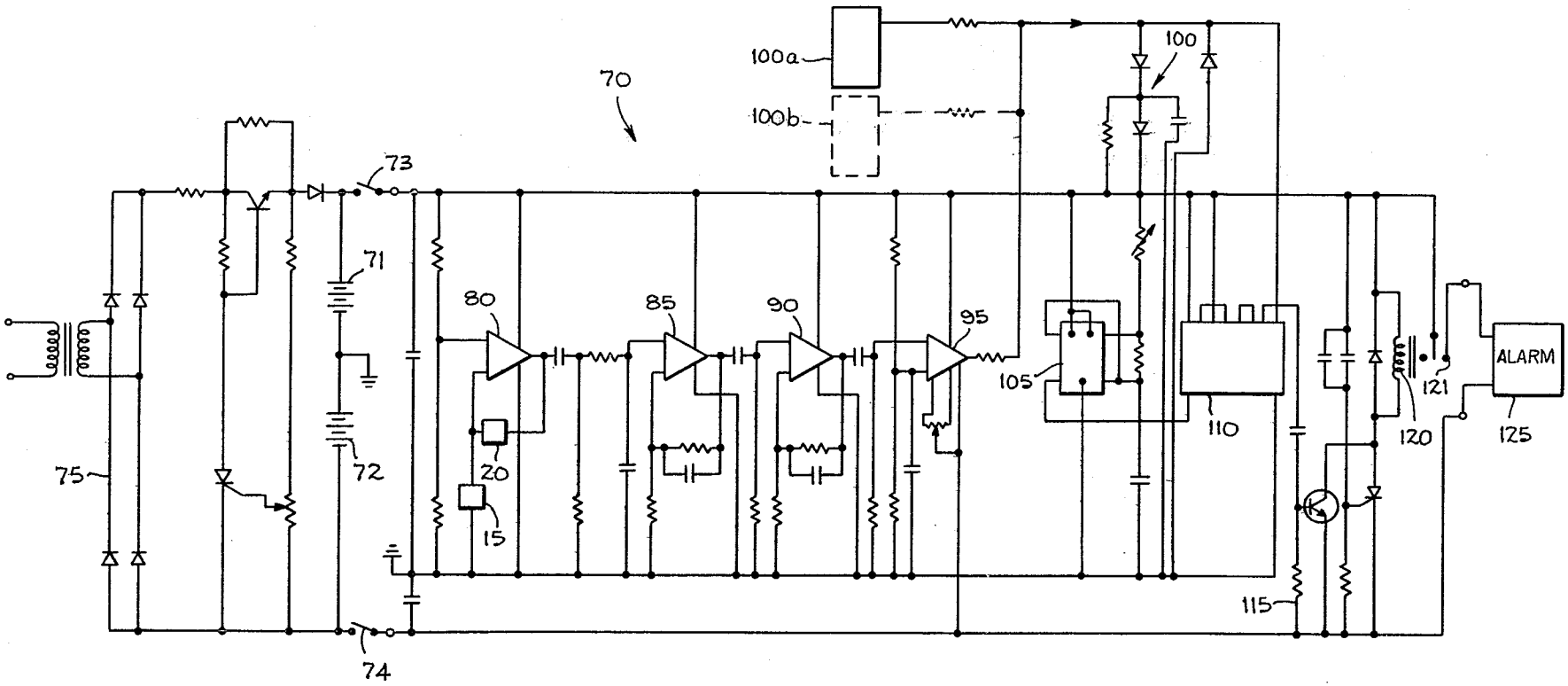
FIG. 7 is a schematic diagram of another intrusion detection system embodying the present invention.

Illustrated in FIG. 7 is a passive intrusion detection circuit 70 embodying the present invention. The intrusion detection circuit 70 comprises a suitable source of electrical energy such as batteries 71 and 72. The circuit 70 is turned on through suitable switches 73 and 74. A conventional battery charger 75 is provided, which may be plugged into a wall outlet of a conventional electrical installation. When the switches 73 and 74 are closed, a suitable operating voltage is applied to the intrusion detection system 70.

Also included in the intrusion detection system 70 are the sensing elements 15 and 20. The sensing elements 15 and 20 are operatively controlled by the optical means 25 in a manner heretofore described in detail in connection with the intrusion detection system 10. The optical device 25 caused the sensing elements 15 and 20 to be excited alternately in applying differential signals to the input side of a conventional differential circuit 80. The output differential signals produced by the differential circuit 80 are applied to the input side of a suitable amplifier circuit 85 having a band pass filter. Another amplifier circuit 90 with a band pass filter is connected to the output side of the amplifier circuit 85.

The output of the amplifier circuit 90 is applied to a conventional comparator circuit 95 to produce a comparative signal from the amplified differential signals. The output of the comparator circuit 95 is applied to a conventional summing circuit 100, which produces an output signal equal to the weighted sum of the input signals. The summing circuit 100 has applied thereto comparative signals from slave circuits **100*a* and 100*b*, et cetera. Each slave circuit includes a differential circuit, a comparator circuit and amplifier circuits, such as circuits 80, 95, 85 and 90. The components of the slave circuits operate and perform in the manner described for the aforementioned components and are connected to sensing elements similar to sensing elements 15 and 20 and also employ optical devices similar to optical device 25. The slave optical devices will cover the same area of surveillance as does the optical device 25. Signals from the summing circuit 100 of sufficient magnitude will in cooperation with a suitable clock circuit 105 produce pulses for each signal transmitted from the summing circuit 100** of sufficient magnitude.

Each pulse produced is counted by a suitable counter circuit 110. When the counter 110 is stepped by a predetermined number of pulses to ensure a minimum number of target signals in succession, a power amplifier 115 is activated. In the output circuit of the power amplifier 115 is a relay 120 that is energized upon the activation of the power amplifier 115. The energization of the relay 120 closes contacts 121 to operate a suitable alarm 125. The opening of the switches 73 and 74 discontinues the operation of the alarm 125 and resets the circuit of the system 70 to the initial state.

It is apparent that the system of the present invention can employ a single amplifier connected to the sensing elements or an amplifier for each sensing element in which the amplifiers are connected respectively to the sensing elements.

I claim:

1. In an intrusion detection system, a mirror for an optical sensing system comprising a concave reflecting surface, said concave reflecting surface including a plurality of reflecting segments, each of said reflecting segments having the same curvature in one direction, said reflecting segments having different curvatures in another direction.

2. In an intrusion detection system, a mirror as claimed in claim 1 wherein said one direction is in the vertical direction and said other direction is in the horizontal direction.

3. In an intrusion detection system, a mirror as claimed in claim 2 wherein said reflecting segments are vertically disposed in a juxtaposed relation.

4. In an intrusion detection system, a mirror as claimed in claim 3 wherein said reflecting segments have different size areas of reflective surfaces.

5. In an intrusion detection system, a mirror as claimed in claim 4 wherein the said reflecting segments have different focal lengths in said other direction.

6. In an intrusion detection system, optical detector means including a mirror comprising a plurality of pairs of reflecting segments, said pairs of reflecting segments being arranged to form a concave reflecting surface, the reflecting segments of each pair of reflecting segments being formed with the same curvature in one direction and with the same curvature in another direction, each of said reflecting segments having the same curvature in said one direction, said pairs of reflecting segments having different curvatures in said other direction.

7. In an intrusion detection system, optical detector means as claimed in claim 6 wherein said one direction is in the vertical direction and said other direction is in the horizontal direction.

8. In an intrusion detection system, optical detector means as claimed in claim 7 wherein said reflecting segments are vertically disposed in a juxtaposed relation.

9. In an intrusion detection system, optical detector means as claimed in claim 8 wherein said pairs of reflecting segments have different size areas of reflective surfaces.

10. In an intrusion detection system, optical detector means as claimed in claim 9 wherein said pairs of reflecting segments have different focal lengths in said one direction.

11. In an intrusion detection system, optical detector means as claimed in claim 10, wherein one pair of reflecting segments has its reflecting segments disposed at the outermost reflecting surface of said concave reflecting surface, another pair of said reflecting segments has its reflecting segments disposed adjacent one another at the centermost reflecting surface of said concave reflecting surface, and a third pair of said reflecting segments has its reflecting segments disposed between the reflecting segments of said one pair of reflecting segments and said other pair of reflecting segments.

12. In an intrusion detection system, optical detector means as claimed in claim 11 and further comprising a plurality of sensing elements, the cluster of which is disposed at the center of said concave reflecting surface.

13. In an intrusion detection system, optical detector means as claimed in claim 12 and further comprising an amplifier connected to at least one of said sensing elements and disposed adjacent to said sensing elements for reducing the pick-up of electromagnetic interference.

14. In an intrusion detection system, optical detector means as claimed in claim 11 and further comprising a plurality of sensing elements and wherein said mirror is a sensing mirror for detecting radiation energy from intrusion in an area under surveillance, and said intrusion detection system further comprising a focusing mirror positioned to receive reflected sensed radiation energy from said sensing mirror and to cast the reflected sensed radiation energy onto said sensing elements.

15. An intrusion detection system comprising:

(a) optical sensing means for sensing radiation energy in an area under surveillance, said optical sensing means comprising a plurality of pairs of reflecting segments, said pairs of reflecting segments being arranged to form a concave reflecting surface, the reflecting segments of each pair of reflecting segments being formed with the same curvature in one direction and with the same curvature in another direction, each of said reflecting segments having the same curvature in one direction, said pairs of reflecting segments having different curvatures in said other direction;

(b) a plurality of radiation sensing elements on which said optical sensing means impinges radiation energy for producing detection signals;

(c) circuit means connected to said radiation sensing elements for comparing detection signals to produce an alarm activating signal; and (d) an alarm connected to said circuit means and activated by said circuit means in response to said circuit means producing an alarm activating signal.

16. An intrusion detection system as claimed in claim 15 wherein said one direction for said optical sensing means is in the vertical direction and said other direction for said optical sensing means is in the horizontal direction.

17. An intrusion detection system as claimed in claim 16 wherein said reflecting segments for said optical sensing means are vertically disposed in juxtaposed relation.

18. An intrusion detection system as claimed in claim 17 wherein said pairs of reflecting segments for said optical sensing means have different size areas.

19. An intrusion detection system as claimed in claim 18 wherein said pairs of reflecting segments for said optical sensing means have different focal lengths in said one direction.

20. An intrusion detection system as claimed in claim 19 wherein said optical sensing means has one pair of reflecting segments disposed at the outermost reflecting surface of said concave reflecting surface, said optical sensing means has another pair of reflecting segments disposed adjacent one another at the centermost reflecting surface of said concave reflecting surface, and said optical sensing means having a third pair of reflecting segments with the respective reflecting segments thereof disposed between said reflecting segments of said one pair of reflecting segments and said other pair of reflecting segments.

21. An intrusion detection system as claimed in claim 20 wherein said optical sensing means further comprises a focusing mirror positioned to reflect sensed radiation energy from said pairs of reflecting segments and to cast the reflected sensed radiation energy onto said sensing elements.

22. An intrusion detection system as claimed in claim 21 wherein said circuit means comprises means for integrating said alarm activating signals to activate said alarm in response to a predetermined number of signals.

23. An intrusion detection system as claimed in claim 21 wherein said circuit means comprises means for counting said alarm activating signals to activate said alarm in response to a predetermined number of alarm activating signals.

24. An intrusion detection system as claimed in claim 22 wherein said circuit means comprises means for integrating said alarm activating signals to activate said alarm in response to a predetermined number of alarm activating signals of a minimum predetermined magnitude.

25. An intrusion detection system as claimed in claim 23 wherein said circuit means comprises means for counting said alarm activating signals to activate said alarm in response to a predetermined number of alarm activating signals of a minimum predetermined magnitude.

26. An intrusion detection system as claimed in claim 24 wherein said circuit means comprises means for producing weighted alarm activating signals prior to the integration thereof.

27. An intrusion detection system as claimed in claim 25 wherein said circuit means comprises means for producing weighted alarm activating signals prior to the counting thereof.

28. In an intrusion detection system, optical detector means as claimed in claim 8 and further comprising a plurality of sensing elements and wherein said mirror is a sensing mirror for detecting radiation energy from intrusion in an area under surveillance, and said intrusion detection system further comprising a focusing mirror positioned to receive reflected sensed radiation energy from said sensing mirror and to cast the reflected sensed radiation energy onto said sensing elements, said sensing mirror sensing an area of surveillance of a predetermined extent in the horizontal direction, said focusing mirror increasing the vertical extent of the area under surveillance.

29. In an intrusion detection system, optical detector means as claimed in claim 28 wherein said sensing mirror and said focusing mirror form columns of variations in intensity of radiation energy which are impinged on said sensing elements by said focusing mirror, said sensing elements producing differential signals in the output thereof in response to the impingement of radiation energy thereon.

30. In an intrusion detection system, optical detector means as claimed in claim 29 wherein each of said reflecting segments senses a predetermined field, said sensing elements producing detection signals in the output thereof in response to each reflecting segment's individually sensing the movement of an intruder in the associated field thereof.

* * * * *